US012281795B1

(12) United States Patent
Boardman et al.

(10) Patent No.: US 12,281,795 B1
(45) Date of Patent: Apr. 22, 2025

(54) CLUSTER OF SWIRLED MINI-MIXERS FOR FUEL-STAGED, AXIALLY STAGED COMBUSTION

(71) Applicant: RTX Corporation, Farmington, CT (US)

(72) Inventors: Gregory Boardman, Owens Cross Roads, AL (US); Stephen Kramer, Cromwell, CT (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 18/601,912

(22) Filed: Mar. 11, 2024

(51) Int. Cl.
*F23R 3/34* (2006.01)
*F23R 3/28* (2006.01)
*F23R 3/50* (2006.01)

(52) U.S. Cl.
CPC ..... *F23R 3/346* (2013.01); *F23R 3/286* (2013.01); *F23R 3/50* (2013.01); *F23R 2900/03343* (2013.01)

(58) Field of Classification Search
CPC ..... F23R 3/346; F23R 3/286; F23R 3/34
See application file for complete search history.

(56) References Cited

U.S. PATENT DOCUMENTS 5,749,219 A * 5/1998 DuBell ..... F23R 3/346 60/737
5,836,164 A * 11/1998 Tsukahara ..... F23R 3/346 60/737
6,026,645 A * 2/2000 Stokes ..... F23R 3/286 60/737
6,038,861 A * 3/2000 Amos ..... F23R 3/34 60/737
6,082,111 A * 7/2000 Stokes ..... F23R 3/286 60/737
6,883,329 B1 * 4/2005 Martling ..... F02C 7/22 60/746
7,707,833 B1 * 5/2010 Bland ..... F23R 3/286 60/737
8,438,851 B1 * 5/2013 Uhm ..... F23R 3/286 60/737
8,769,955 B2 7/2014 Van Nieuwenhuizen et al.
11,137,144 B2 10/2021 Wilson et al.
2001/0004827 A1 * 6/2001 Vandervort ..... F23R 3/36 60/737
2003/0110774 A1 * 6/2003 Saitoh ..... F23R 3/14 60/737
2005/0282097 A1 * 12/2005 Carrea ..... F23C 9/006 431/9
2010/0077760 A1 * 4/2010 Laster ..... F23R 3/286 60/742

(Continued)

*Primary Examiner* — William H Rodriguez
(74) *Attorney, Agent, or Firm* — Kinney & Lange, P. A.

(57) ABSTRACT

A main injector can include multiple sub-element mixers. A first sub-element mixer includes a first main air nozzle circumscribing a first main fuel nozzle. A second sub-element mixer includes a second main air nozzle circumscribing a second main fuel nozzle. An annular combustor can include a circumferential array of main injectors disposed proximate a pilot injector. Each main injector of the array of main injectors can be oriented with first sub-element mixers proximate to the pilot injector and second sub-element mixers spaced axially downstream relative to first sub-element mixers in a staged configuration.

15 Claims, 7 Drawing Sheets

(56) References Cited

U.S. PATENT DOCUMENTS

2010/0170254 A1* 7/2010 Venkataraman ..... F02C 7/228 60/746
2010/0186413 A1* 7/2010 Lacy ..... F23R 3/286 239/548
2010/0229557 A1* 9/2010 Matsumoto ..... F23R 3/34 60/737
2010/0251725 A1* 10/2010 Dodo ..... F23R 3/286 60/746
2010/0293955 A1* 11/2010 Berry ..... F23R 3/10 60/742
2011/0185703 A1* 8/2011 Dodo ..... F23R 3/34 60/39.461
2012/0167578 A1* 7/2012 Berry ..... F23D 14/82 60/737
2012/0180487 A1* 7/2012 Uhm ..... F23R 3/286 60/737
2012/0180495 A1* 7/2012 Uhm ..... F23R 3/286 60/746
2012/0198856 A1* 8/2012 Uhm ..... F23M 20/005 60/737
2012/0210717 A1* 8/2012 Baruah ..... F23L 7/007 60/742
2012/0255310 A1* 10/2012 Stewart ..... F23C 7/006 60/734
2012/0266602 A1* 10/2012 Haynes ..... F23R 3/14 60/746
2013/0227928 A1* 9/2013 Uhm ..... F23R 3/286 29/889.22
2013/0227953 A1* 9/2013 Uhm ..... F02C 3/30 60/738
2013/0232979 A1* 9/2013 Singh ..... F23R 3/286 60/737
2014/0033718 A1* 2/2014 Manoharan ..... F23R 3/10 60/725
2014/0053528 A1* 2/2014 Crothers ..... F23R 3/18 60/39.37
2014/0083102 A1* 3/2014 Miura ..... F23R 3/10 60/737
2014/0150434 A1* 6/2014 Belsom ..... F23R 3/286 60/739
2014/0182294 A1* 7/2014 Matsumoto ..... F23R 3/286 60/737
2014/0318135 A1* 10/2014 Knapp ..... F23R 3/46 60/737
2015/0211742 A1* 7/2015 Lee ..... F23R 3/286 60/737
2015/0285504 A1* 10/2015 Melton ..... B23K 26/702 60/737
2016/0209040 A1* 7/2016 Tamura ..... F02C 3/14
2016/0273449 A1* 9/2016 DiCintio ..... F23D 11/16
2017/0307210 A1* 10/2017 Hirano ..... F23C 3/002
2017/0321609 A1* 11/2017 Ogata ..... F02C 7/228
2018/0363912 A1* 12/2018 Graham ..... F23R 3/283
2019/0056112 A1* 2/2019 Natarajan ..... F23R 3/46
2019/0128525 A1* 5/2019 Han ..... F23R 3/14
2019/0128527 A1* 5/2019 Cho ..... F23R 3/286
2020/0263873 A1* 8/2020 Boardman ..... F02C 7/22
2022/0389863 A1* 12/2022 Scipio ..... F02C 7/30
2023/0417413 A1* 12/2023 Kasuya ..... F23R 3/30

* cited by examiner

CLUSTER OF SWIRLED MINI-MIXERS FOR FUEL-STAGED, AXIALLY STAGED COMBUSTION

BACKGROUND

The present disclosure relates generally to combustors for gas turbine engines, and more particularly, main injectors for axially staged combustion.

Gas turbine engines produce thrust and/or work by combustion, which discharges nitrous oxide, nitrous dioxide, and other NOx and particle emissions in the exhaust flow. Control of the air-fuel ratio within the combustor aims to limit NOx production and reduce the size and number of particles discharged into the exhaust flow. Prior attempts to manage air-fuel ratio of combustion includes controlling fuel flow rate entering the combustion chamber through injectors. Bulk inlet area of air entering the combustor remains constant while fuel volume varies among gas turbine engine operating conditions, which produces non-optimum air-fuel ratios within the combustor and consequently excess NOx and particle emissions. Accordingly, further development of features for reducing NOx and particle emissions are highly desirable.

SUMMARY

A main injector in accordance with an example embodiment of this disclosure includes a plurality of sub-element mixers. The plurality of sub-element mixers includes a first sub-element mixer comprising a first main air nozzle circumscribing a first main fuel nozzle and a second sub-element mixer comprising a second main air nozzle circumscribing a second main fuel nozzle.

An annular combustor in accordance with another example embodiment of this disclosure includes an inner combustion liner assembly, an outer combustion liner assembly, a forward assembly, a pilot injector, and a main injector. The outer combustor liner assembly is spaced radially from the inner combustor liner assembly relative to an engine axis to form a combustion chamber. The forward assembly joins the inner combustor liner assembly to the outer combustor liner assembly. The pilot injector extends through the forward assembly. The main injector extends through the outer combustor liner assembly. The main injector includes a plurality of sub-element mixers. The plurality of sub-element mixers includes a first sub-element mixer comprising a first main air nozzle circumscribing a first main fuel nozzle and a second sub-element mixer comprising a second main air nozzle circumscribing a second main fuel nozzle.

In a further example embodiment of the main injector and the annular combustor includes a main injector in which the first main fuel nozzle and the first main air nozzle are operatively associated with a first air-fuel ratio that is different than a second air-fuel ratio operatively associated with the second main fuel nozzle and the second main air nozzle.

DETAILED DESCRIPTION

Figure 1:
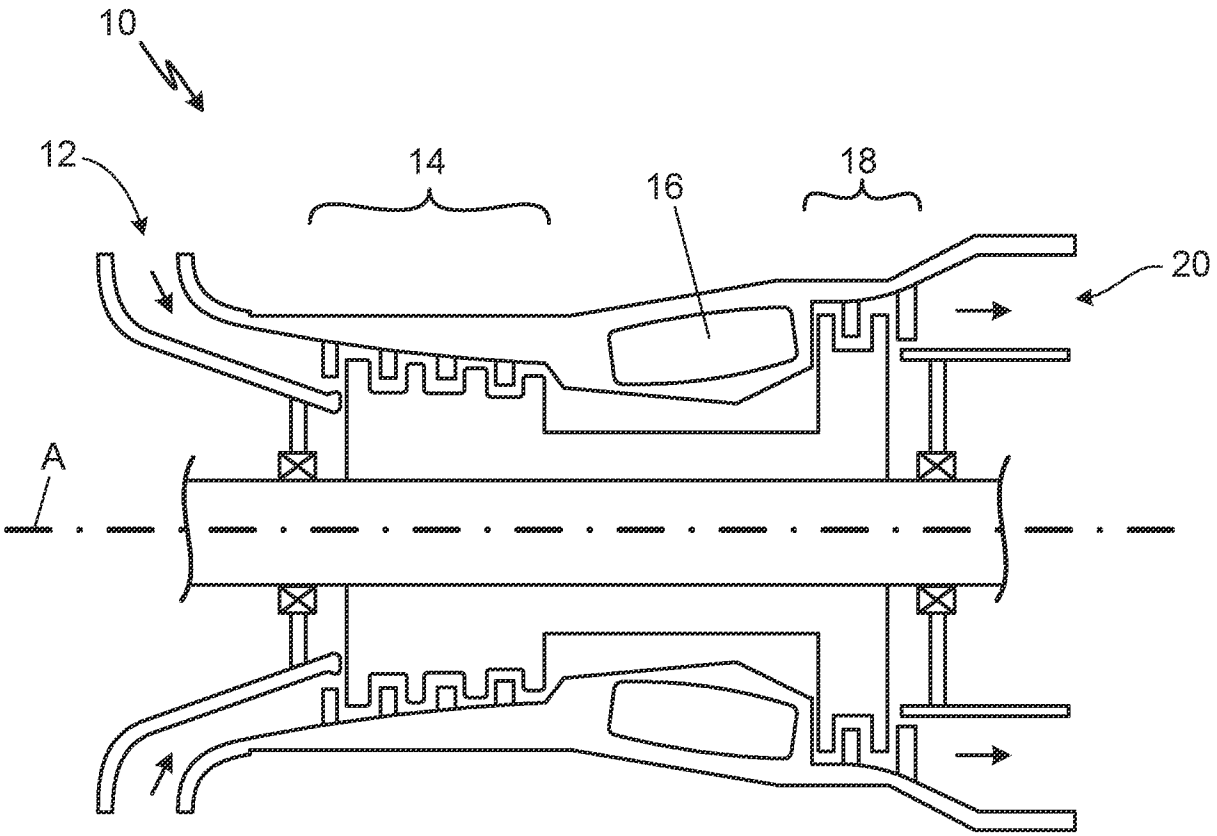
FIG. 1 is a schematic representation of a gas turbine engine.

FIG. 1 is a schematic cross-sectional view of gas turbine engine 10, which is depicted with single spool architecture. In other examples, gas turbine engine 10 can be configured with two spools (e.g., a dual-spool architecture), or more than two spools (e.g., a power turbine or a topping cycle spool non-concentrically arranged with respect to one or more primary spools). Gas turbine engine 10 can be configured as a propulsion engine, for example, a turbofan engine, a turboprop engine, and/or a turboshaft engine. In other examples, gas turbine engine 10 can be an industrial gas turbine engine driving a load (e.g., an electric machine). The architecture of gas turbine engine 10 depicts a forward-to-aft main gas flow path in which the engine ingests air into a forward portion of the engine that flows aft through the compressor section, the combustor, and the turbine section before discharging from an aft portion of the engine. In other examples, gas turbine engine 10 can have a reverse-flow architecture in which the engine ingests air into an aft portion of the engine that flows forward through the compressor section, the combustor, and the turbine section before discharging through an exhaust at a forward portion of the engine. Each compressor and/or turbine section can have one or more stages. Each stage can include at least one rotor of circumferentially spaced blades and at least one stator of circumferentially spaced and stationary vanes. As depicted, gas turbine 10 includes multiple compressor stages and multiple turbine stages. However, other examples of gas turbine engine 10 can have more stages or less stages than the number of compressor stages and/or turbine stages depicted by FIG. 1.

As depicted in FIG. 1, gas turbine engine 10 includes, in serial flow communication, air inlet 12, compressor section 14, combustor 16, turbine section 18, and exhaust section 20. Compressor section 14 pressurizes air entering gas turbine engine 10 through air inlet 12. The pressurized air discharged from compressor section 14 mixes with fuel inside combustor 16. Igniters initiate combustion of the air-fuel mixture within combustor 16, which is sustained by a continuous supply of fuel and pressurized air and/or igniter activation. A heated and compressed air stream discharges through turbine section 18 and exhaust section 20. Turbine section 18 extracts energy from the exhaust stream to drive compressor section 14 and other engine accessories such as electrical generators and pumps for lubrication, fuel, and/or actuators.

Figure 2:
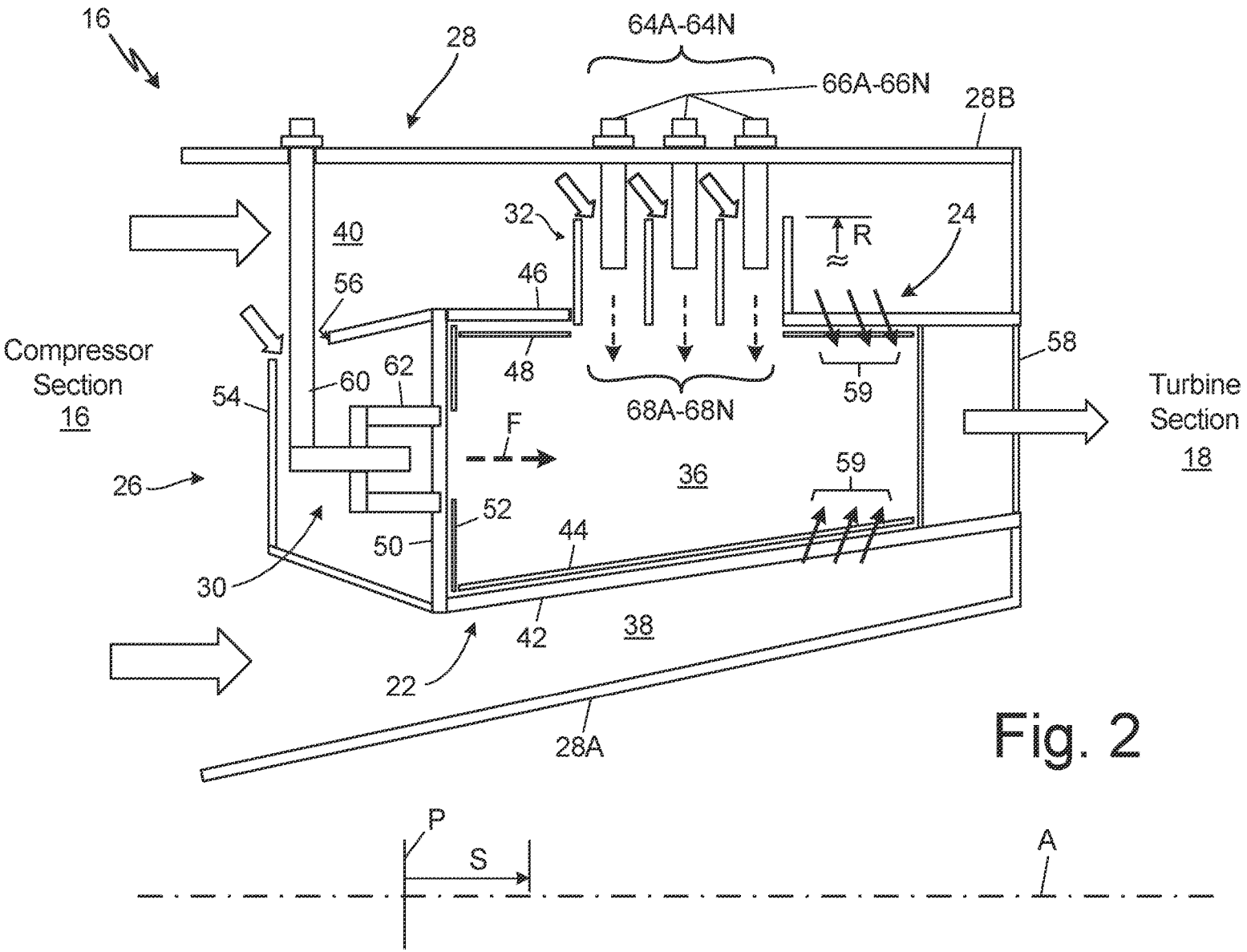
FIG. 2 is a schematic view of an example combustor and main injector with multiple sub-element mixers.

FIG. 2 is a schematic cross-sectional view of an example combustor of gas turbine engine 10. As depicted, combustor 16 includes inner combustor liner assembly 22, outer combustor liner assembly 24, forward assembly 26, diffuser case module 28, one or more pilot injectors 30, and one or more main injectors 32. Inner combustor liner assembly 22 and outer combustor liner assembly 24 are spaced radially to define combustion chamber 36, which has an annular cross-sectional shape with respect to engine axis A. Inner combustor liner assembly 22 is radially outward from inner differ case 28A of diffuser case module 28 to define inner annular plenum 38. Outer combustor liner assembly 24 is radially inward from outer diffuser case 28B of diffuser case module 28 to define outer annular planum 40. Forward assembly 26 spans between and connects inner combustor liner assembly 22 to outer combustor liner assembly 24 and is located downstream from an inlet of combustor 16. While a particular configuration of combustor 16 is illustrated and described below, other combustor types with various other details and configurations will benefit from features of main injector 32.

Inner combustor liner assembly 22 includes inner support shell 42 and one or more inner liner panels 44. Outer combustor liner assembly 24 includes outer support shell 46 and one or more outer liner panels 48. Forward assembly 26 includes bulkhead shell 50, one or more bulkhead liner panels 52, and annular hood 54. Inner liner panels 44 and outer liner panels 48 are circumferentially and/or axially spaced to define an annular boundary to combustion chamber 36. Inner support shell 42 and outer support shell 46 are connected to inner liner panels 44 and outer liner panels 48 respectively to provide support thereto. Annular hood 54 extends between and is secured to forward-most ends of inner support shell 42 and outer support shell 46. Openings 56 extend through annular hood 54 for receiving pilot injectors 30 and receiving a portion of air from compressor section 14 within forward assembly 26. At opposite, downstream-most ends, inner shell 42 and outer shell 46 join to inlet guide vane assembly 58, which includes an array of circumferentially spaced stationary vanes. The cumulative open area between the stationary guide vanes defines an exit of combustor 16, which communicates with turbine section 18. Inner combustor liner assembly 22, outer combustor liner assembly 24, and/or forward assembly 26 can include multiple dilution holes, such as dilutions holes 59, for communicating air from within inner annular plenum 38, outer annular plenum 40, and/or forward assembly 26 into combustion chamber 36.

Combustor 16 can include multiple pilot injectors 30 circumferentially spaced about engine axis A at forward assembly 26. Pilot injectors 30 include pilot fuel nozzles 60 and pilot swirlers 62. Pilot fuel nozzles 60 are supported from outer diffuser case of diffuser case module 28 and extend radially inward through openings 56 in annular hood 54 to direct fuel through openings formed by bulkhead shell 50 and bulkhead liners 52. Pilot swirlers 62 are supported from bulkhead shell 50 of forward assembly 26 and circumscribe respective pilot fuel nozzles 60. Fuel directed through pilot fuel nozzles 60 and air directed through pilot air swirlers 62 provide an air-fuel mixture along axis F into a forward region of combustion chamber 36.

Igniters (not shown) are supported from outer diffuser case 28B and extend through outer combustion liner assembly 24 to communicate with combustion chamber 36. Igniters are disposed downstream relative to pilot injectors 30 and upstream relative to main injectors 32 such that igniters are disposed between the axial locations of pilot injectors 30 and main injectors 32 along engine axis A. Igniters activate to initiate combustion within combustion chamber 36 and deactivate during other phases of gas turbine engine operation.

Main injectors 32 extend through outer combustor liner assembly 24 to output one or more air-fuel mixtures into combustion chamber 36 axially downstream from igniter and pilot injectors 30. Each main injector 32 includes at least two sub-element mixers 64A-64B and up to an arbitrary number "N" of sub-element mixers (collectively sub-element mixers 64A-64N). In some examples, main injector 32 includes peripheral body 65 circumscribing sub-element mixers 64A-66N. In other examples, main injectors 32 include multiple interconnected sub-element mixers 64A-64N in which each sub-element mixer is joined with at least one adjacent sub-element mixer. Main injectors 32 can be oriented normal to outer combustor liner assembly 24. In other examples, main injectors 32 can define an oblique angle with respect to outer combustor liner assembly 24, which may be oriented to direct an air-fuel mixture in a downstream direction (i.e., towards turbine section 18), to direct the air-fuel mixture in an upstream direction (i.e., towards pilot injector 30), or to direct the air-fuel mixture in a circumferential direction (i.e. in a chordal fashion around the circumference of the combustor), or in variations of these orientations.

Sub-element mixers 64A-64N include main fuel nozzles 66A-66N and main air nozzles 68A-68N, each main air nozzle circumscribing a respective main fuel nozzle. Main fuel nozzles 66A-66N are supported by outer diffuser case 28B and extend radially inward through openings of outer combustor liner assembly 24. Each main fuel nozzle 66A-66N includes respective fuel feed passages 74A-74N extending longitudinally through the main fuel nozzle and terminating at one or more orifices and/or annular nozzle passages that cumulatively define a main fuel nozzle outlet area. Main air nozzles 68A-68N are connected to and circumscribe respective main fuel nozzles 66A-66N, which extend through an opening of outer combustor liner assembly 24.

In one example, one or more of main air nozzles 68A-68N can include a cylindrical ring circumscribing an outer periphery of one of fuel nozzles 66A-66N and vanes extending between the cylindrical ring and the main fuel nozzle. The vanes can be angled in order to induce swirl into the air flowing through the main air nozzle (i.e., a main air swirler).

In another example, one or more main air nozzles 68A-68N can include a body circumscribing the outer periphery of one of fuel nozzles 66A-66N that includes one or more perforations disposed at inlet ends, outlet ends, or at an intermediate location therebetween of main air nozzles 66A-66N. Perforations can be oriented to direct air longitudinally along respective fuel nozzles 66A-66N. In other examples, perforations can be angled inward towards respective fuel nozzles 66A-66N to intersect and mix with fuel (e.g., a conical arrangement). In further examples, perforations can be angled inward toward respective fuel nozzles 66A-66N and angled circumferentially to induce swirl into the air flowing therethrough (i.e., a main air swirler).

Air nozzle areas are defined by the minimum cumulative open area of each main air nozzle 68A-68N. Inlets of main air nozzles 68A-68N communicate with outer annular plenum 40. The radial distance R of main air nozzle inlets relative to engine axis A can be the same in some examples of main injector 32. In other examples, the radial distance R of one or more main air nozzle inlets can differ to reduce unwanted leakage through inactive sub-element mixers 64A-64N. For instance, main air nozzle inlets that are downstream from one or more other main air nozzle inlets of main injector 32 can be located at greater radial distances relative to engine axis A relative to upstream main air swirler inlets. Sub-element mixers 64A-64N can be characterized by an area ratio of the main air nozzle area and the main fuel outlet area of respective main air nozzles 68A-68N and fuel nozzles 66A-66N. The size of fuel outlet area, the size of air nozzle area, and hence the area ratio of each sub-element mixer can be sized to deliver a target air-fuel ratio, or a target air-fuel ratio range, given a particular fuel supply pressure and combustor supply air pressure, or a given range of fuel supply pressures and combustor supply air pressures.

Main injectors 32 can receive fuel from one or more sources, each fuel source supplying fuel to main injectors 32 at a target fuel pressure and a target flow rate, or a target fuel pressure range and a target flow rate range. In some examples, one or more sub-element mixers 64A-64N associated with one or more main injectors 32 of combustor 16 receive fuel from different sources. For example, one or more main injectors 32 of combustor 16 may receive fuel from a first source having target operational pressure and flow rate ranges while other main injectors 32 of combustor 16 receive fuel from an independently controllable second fuel source operating at the same or different operation pressure and flow rate ranges.

Features and components of combustor 16 can be described by axial station S, which is the linear distance measured parallel to engine axis A from datum plane P, which is a fictious plane normal to engine axis A. For instance, datum plane P can coincide with forward assembly 26 in some examples of combustor 16 that include bulkhead shell 50 normal to axis A. In other examples of combustor 16 with bulkhead shell 50 oriented obliquely to engine axis A, datum plane P can intersect a portion of bulkhead shell 50, for example, a radially innermost edge, a radially outermost edge, a radially inner most point, or a radially outermost point of bulkhead shell 50. In other examples, datum plane P can be associated with any other location and/or component of gas turbine engine 10 such as air inlet 12. Components of combustor 16 can be described with relative values of axial station S. Axial station S increases in a forward-to-aft direction of gas turbine engine 10. In the depicted example of combustor 16, the forward-to-aft direction coincides with an intended flow direction of an air-fuel mixture within combustor 16, which FIG. 2 depicts as a left-to-right direction.

Figure 3:
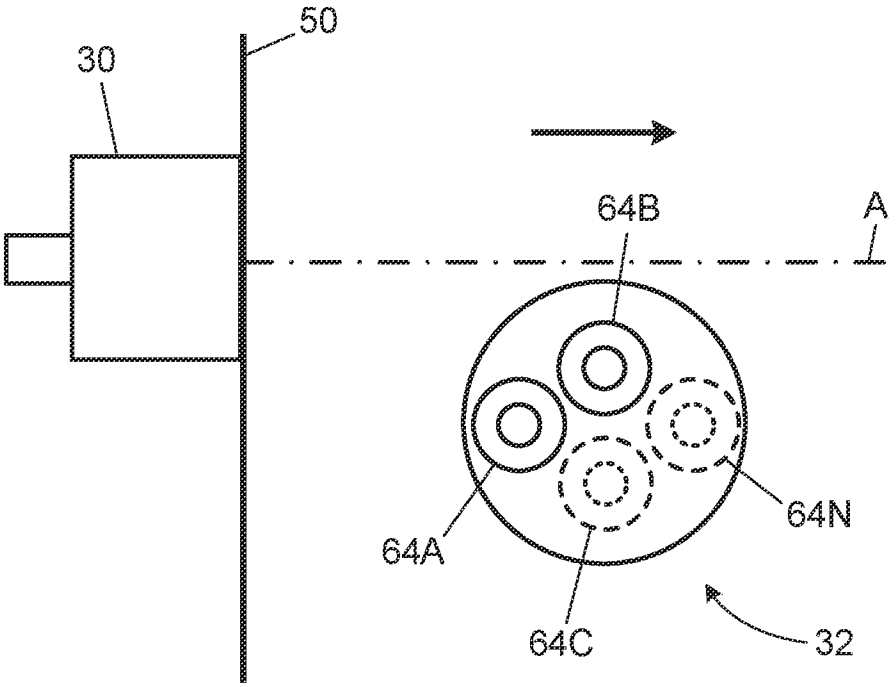
FIG. 3 is a schematic view of a main injector depicting an axially-spaced sub-element mixer arrangement.
Figure 4:
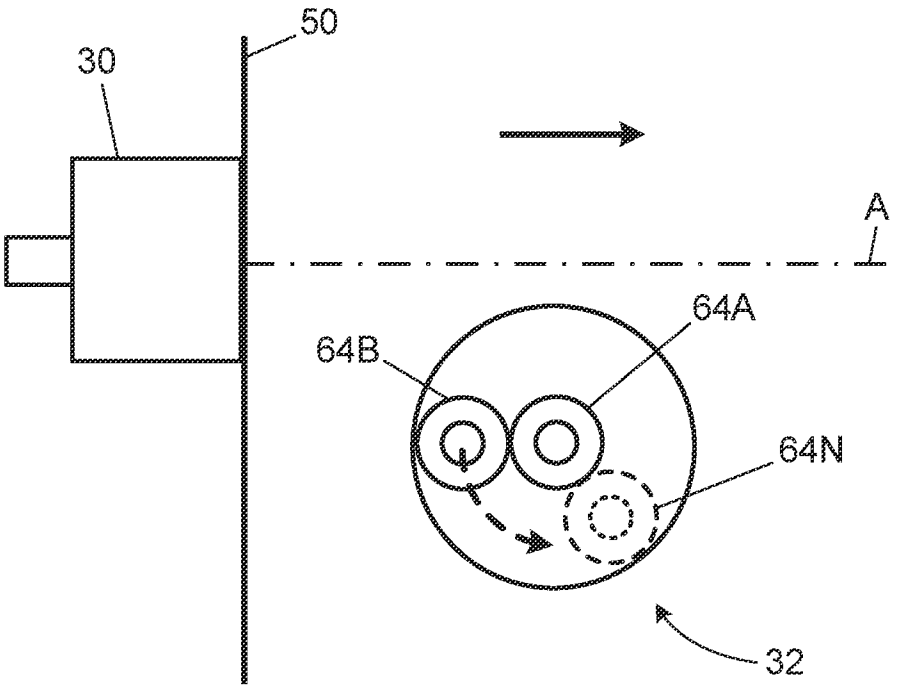
FIG. 4 is a schematic view of a main injector depicting a central sub-element mixer arrangement.

FIG. 3 is a schematic view of an example main injector 32 having sub-element mixers 64A-64N arranged in an axially spaced configuration. FIG. 4 is a schematic view of an example main injector 32 having sub-element mixers 64B-64N arranged about a central sub-element mixer 64A. In each of FIG. 3 and FIG. 4, pilot injector 30, main injector 32, bulkhead shell 50, sub-element mixers 64A-64N, peripheral body 65, and engine axis A are depicted.

Referring to FIG. 3, axially-spaced configurations of main injector 32 can include an arbitrary number of sub-element mixers 64A-64N arranged in multiple axially spaced rows, each row with one or more of sub-element mixers 64A-64N. As shown, main injector 32 includes sub-element mixer 64A and sub-element mixer 64B, and may additionally include sub-element mixer 64C and up to an arbitrary number of sub-element mixers 64N. Sub-element mixers 64A-64N in axially adjacent rows can be circumferentially offset as depicted by FIG. 3, or can be circumferentially aligned in other examples of main injector 32.

As shown by FIG. 4, arrangements of sub-element mixers with a central sub-element mixer include up to an arbitrary number of sub-element mixers 64A-64N. As shown in FIG. 4, main injector 32 includes sub-element mixer 64A that is centrally disposed with respect to peripheral sub-element mixers 64B-64N, which are arranged about the central sub-element mixer 64A. In some central sub-element mixer arrangements, main injector 32 includes three or more peripheral sub-element mixers (e.g., six peripheral sub-element mixers). Peripheral sub-element mixers 64B-64N can be equally spaced about central sub-element mixer 64A in some examples or unequally spaced about central sub-element mixer 64A in other examples.

Main injectors 32 can be circumferentially spaced about combustor 16 in a regularly spaced, or irregularly spaced pattern. Each main injector 32 can include the same arrangement of sub-element mixers 64A-64N as every other main injector 32. In other examples, at least one main injector 32 can include a different arrangement of sub-element mixers 64A-64N in view of the other main injectors 32. In further examples, a subset of main injectors 32 can include a different arrangement of sub-element mixers 64A-64N relative to one or more main injectors 32 of combustor 16.

Sub-element mixers 64A-64N associated with one or more main injectors 32 can extend longitudinally at an angle with respect to outer combustor liner assembly 24. For example, one or more sub-element mixers 64A-64N for main injector 32 can be oriented normal to outer combustor liner assembly 24. Other examples of main injector 32 can include sub-element mixers 64A-64N that form oblique angles to combustor liner assembly 24. Angled sub-element mixers 66A-64N can direct an air-fuel mixture in an upstream direction (i.e., towards forward assembly 26), or in a downstream direction (i.e., towards turbine section 18). The angle of one or more sub-element mixers 66A-66N can direct an air-fuel mixture in a circumferential direction, an upstream circumferential direction, or a downstream circumferential direction. Sub-element mixers 66A-66N of main injector 32 can have the same angular origination with respect to outer combustion liner assembly 24. In other examples, at least one of sub-element mixers 64A-64N has a different angular orientation relative to other sub-element mixers 64A-64N of main injector 32.

Figure 5:
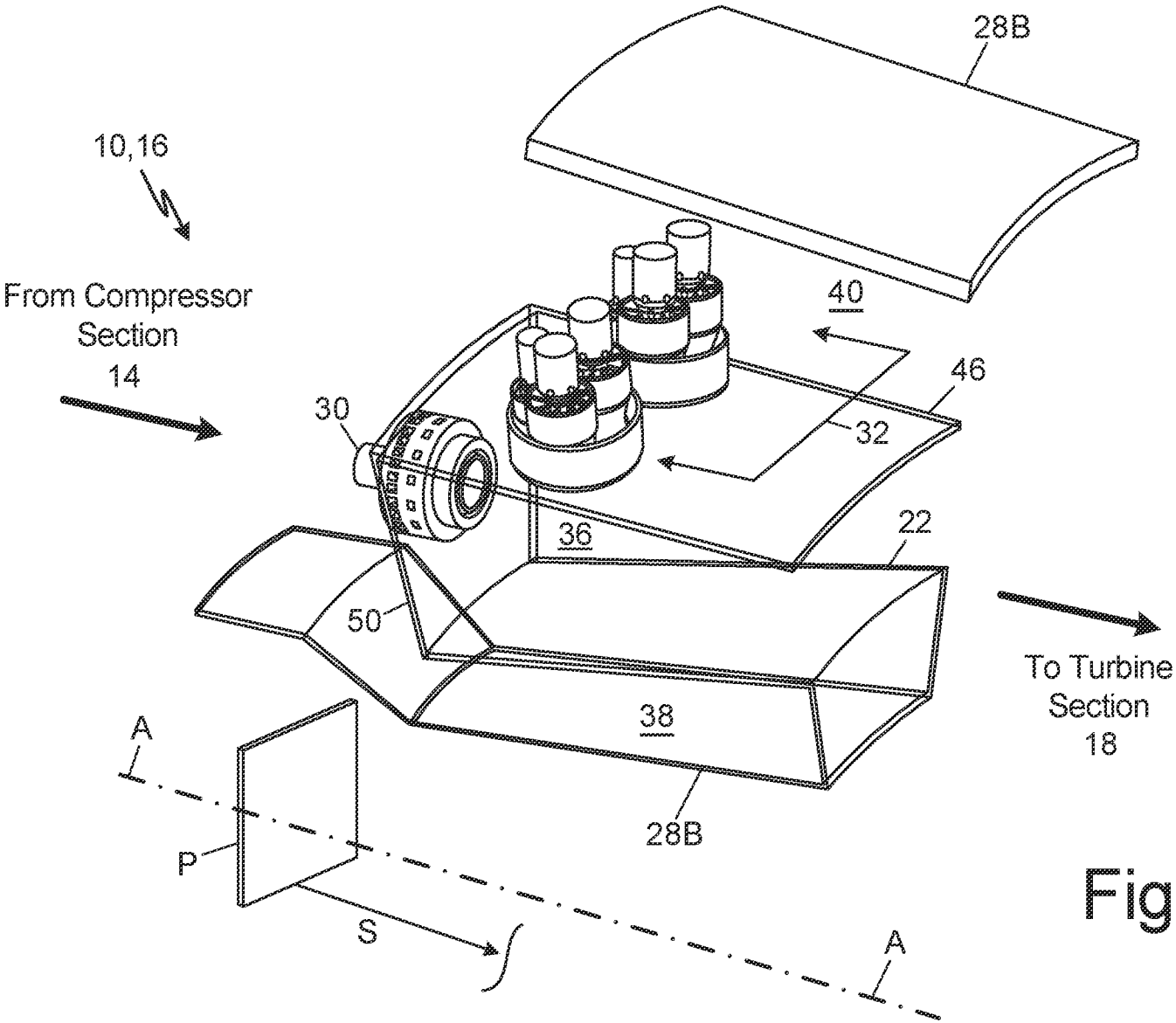
FIG. 5 is an isometric section view of an example combustor and main injector with a triangular sub-element mixer arrangement.
Figure 6:
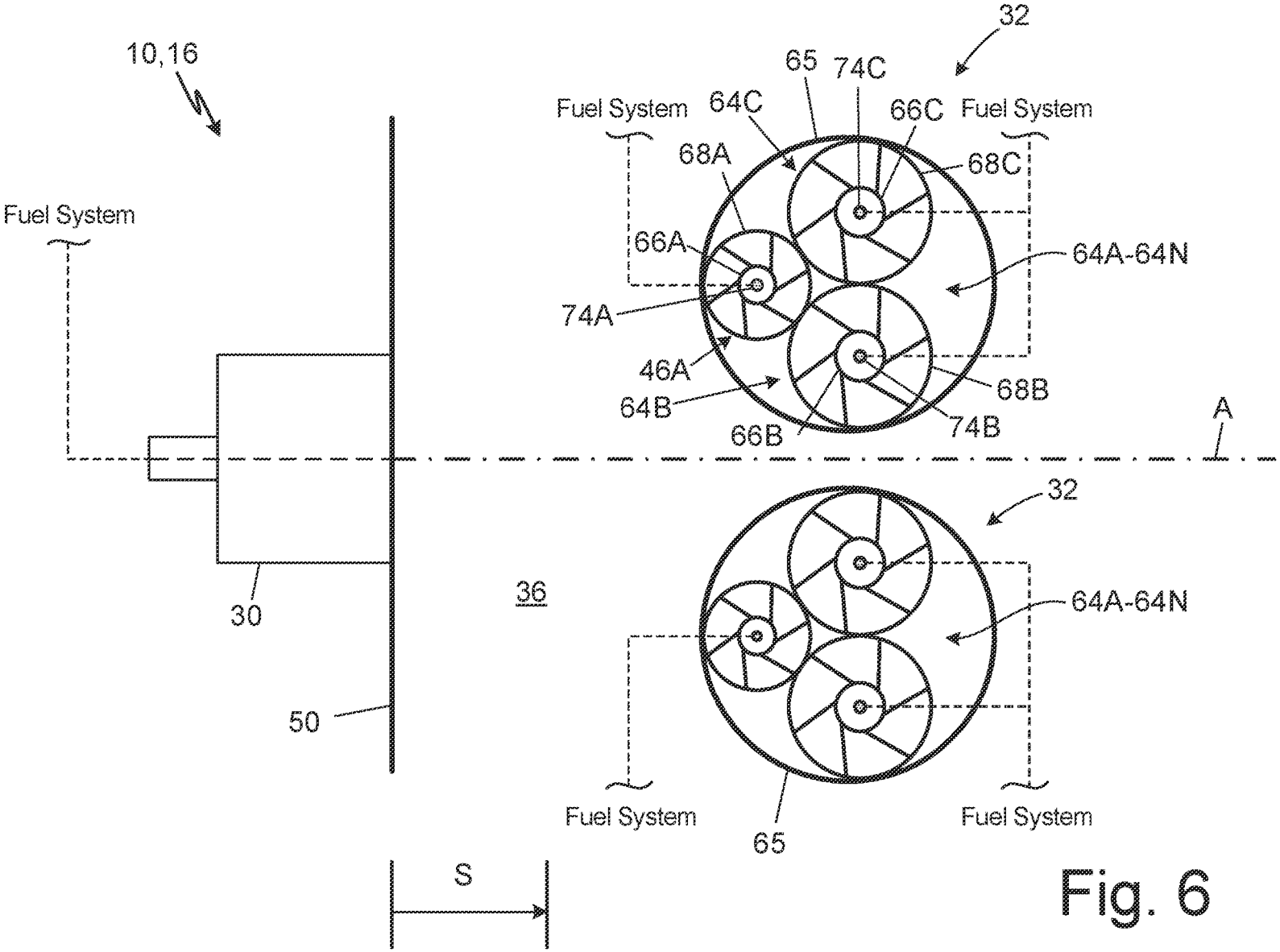
FIG. 6 is a schematic view of the example combustor the example combustor of FIG. 5.
Figure 7:
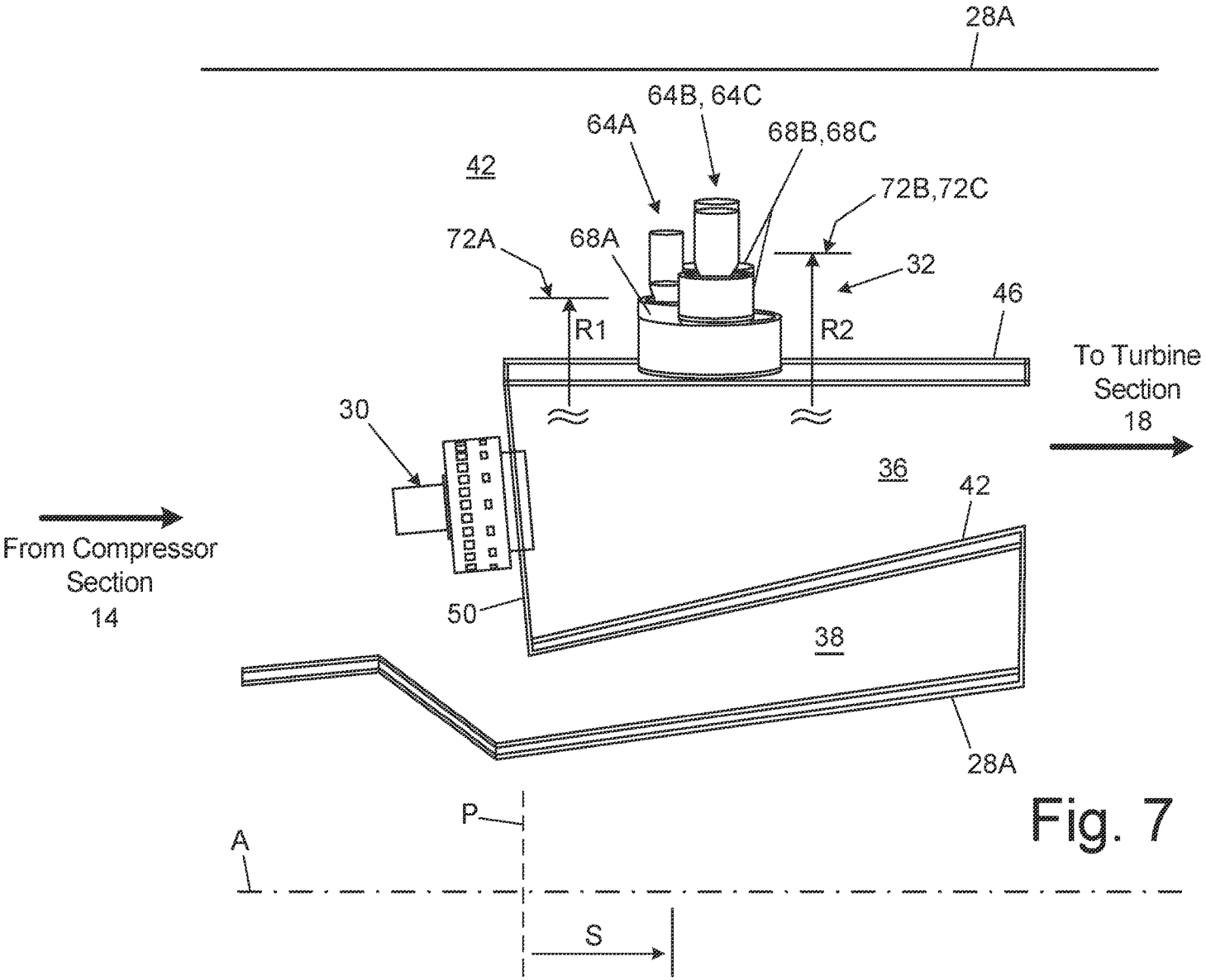
FIG. 7 is a schematic cross-sectional view of the example combustor of FIG. 5.

FIG. 5 is an isometric section view of combustor 16 in which main injector 32 includes a triangular configuration of sub-element mixers. FIG. 6 and FIG. 7 are schematic views of combustor 16 that depict additional details and features of combustor 16. FIG. 5, FIG. 6, and FIG. 7 are discussed together below. Inner combustor liner assembly 22, outer combustor liner assembly 24, forward assembly 26, diffuser case module 28, pilot injector 30, and main injectors 32 are shown. While the depicted example of main injector 32 includes sub-element mixers 64A-64C, it will be understood that main injector 32 can have fewer sub-element mixers or more sub-element mixers in other examples.

Main injectors 32 with three sub-element mixers have sub-element mixers 64A-64C that form a triangular configuration in which each sub-element mixer 64A-64C is disposed at a vertex of a triangle as viewed in FIG. 6. As such, each sub-element mixer abuts, or is proximate, the two other sub-element mixers in the configuration at, for example, respective air swirlers 68A-68C. Triangular configurations, such as these, can have any one of the sub-element mixers 64A-64C orientated towards forward assembly 26, towards turbine section 18, or at any rotational orientation in-between.

Sub-element mixer 64A includes main fuel nozzle 66A and main air nozzle 68A, and sub-element mixer 64B includes main fuel nozzle 66B and main air nozzle 68B. Further sub-element mixer 64C includes main fuel nozzle 66C and main air nozzle 68C. Referring to FIG. 6, main fuel nozzles 66A-66C include respective feed passages 74A, 74B, and 74C (i.e., feed passages 74A-74C) that fluidly communicate with combustion chamber 36 and receive fuel from the gas turbine engine fuel supply system. Feed passages 74A-74C extend longitudinally through respective bodies of main fuel nozzles 66A-66C and terminate at discharge ends of main fuel injectors 32. In some examples, one or more feed passages 74A-74C have multiple inlets and/or multiple outlets to aid fuel distributions through and into combustor 16. In other examples, one or more feed passages 74A-74C may have a single inlet and/or a single outlet, a single inlet paired with multiple outlets, or multiple inlets paired with a single outlet.

Main air nozzles 68A-68C are operatively associated with one of main fuel nozzles 66A-66C. Each main air nozzle 68A-68C includes a cylindrical ring that circumscribes an outer periphery of one of main fuel nozzles 66A-66C. Vanes extend between each cylindrical ring and respective main fuel nozzles 66A-66C to induce swirl of air about the fuel nozzle in operation. As depicted by FIG. 7, inlet ends 72A, 72B, and 72C (i.e., inlet ends (72A-72C) of respective main air nozzles 68A-68C communicate with outer annular plenum 40, and outlet ends of main air nozzles 68A-68C communicate with combustion chamber 36 of combustor 16.

Each sub-element mixer 64A-64C has geometry tailored to deliver a target air-fuel ratio, or a target air-fuel ratio range, as a function of supply fuel pressure and supply air pressure. Main fuel nozzles 66A-66C include one or more orifices (i.e., outlets) at discharge ends of main fuel injectors 32. Main air nozzles 68A-68C include open areas bound by respective, cylindrical rings, vanes, and fuel nozzles. For instance, sub-element mixer 64A includes an area ratio based on an outlet area of fuel nozzle 66A and an open area of air swirler 68A. Similarly, sub-element mixer 64B and sub-element mixer 64C includes area ratios based on outlet areas of respective main fuel nozzles 66B-66C and open areas of respective main air nozzles 68B-68C. Area ratios of each sub-element mixer are equal in some examples of main injector 32. In other examples, one or more area ratios can be different than one or more other area ratios of sub-element mixers 64A-64C. In still other examples, each area ratio differs from every other area ratio. In the example depicted by FIG. 5, FIG. 6, and FIG. 7, an area ratio of sub-element mixer 64A is less than area ratios of sub-element mixers 64B-64C. Further, area ratios of sub-element mixers 64B-64C are equal in the depicted example.

The fuel system can supply fuel to sub-element mixers 64A-64C independently in which each sub-element mixer 64A-64C can receive independently controllable fuel flows, or in one or more groups in which sub-element mixers 64A-64C in each group receives an independently controllable fuel flow that is divided among sub-element mixers within the group. Each group includes at least one sub-element mixer, or more than one sub-element mixer.

In certain examples, sub-element mixer 64A is smaller (i.e., has less outlet area and/or air open area) than sub-element mixers 64B and 64C and is orientated towards forward assembly 26. That is to say, the axial station of sub-element mixer 64A is closer to forward assembly 26 relative to sub-element mixers 64B and 64C, which are located at the same axial station S. Moreover, sub-element mixers 64B and 64C are identical. In this way, sub-element mixer 64A can be operatively associated with an air-fuel ratio optimized for a ground idle and/or a flight idle condition of gas turbine engine 10 while sub-element mixers 64B and 64C can be operatively associated with an air-fuel ratio optimized to operate in conjunction with sub-element mixer 64A at a maximum continuous power condition of gas turbine engine, or at a cruise condition. For example, sub-element mixer 64A can communicate with the first manifold of the fuel system while sub-element mixers 64B and 64C can communicate with a second manifold of the fuel system that is independent from the first manifold. Accordingly, fuel can be supplied to sub-element mixer 64A while sub-element mixers 64B and 64C remain inactive. Moreover, sub-element mixers 64B and 64C may receive fuel while sub-element mixer 64A remains inactive, or all sub-element mixers 64A, 64B, and 64C may receive fuel. In each scenario, fuel can be supplied to a first group (i.e., sub-element mixer 64A) at a first fuel pressure and a first flow rate while fuel supplied to a second group (i.e., sub-element mixers 64B and 64C) at a second fuel pressure and second fuel flow rate, which may be different or the same as needed to operate combustor 16.

One or more sub-element mixers 64A-64C can include a main air nozzle that has an inlet end offset from one or more main air nozzles of other sub-element mixers 64A-64C of main injector. As shown in the example depicted by FIG. 7, inlet end 72A of main air nozzle 68A of sub-element mixer 64A is offset radially (i.e., $\Delta R = R2 - R1$) inward relative to inlet ends 72B-72C of main air nozzle 68B and main air nozzle 68C associated with sub-element mixers 64B and 64C, which are radially coincident. In other examples, each main air nozzle 68A-68C of sub-element mixers 64A-64C can be radially offset from every other main air nozzle 68A-68C. In another example, the radial location of inlet ends 72A-72C of main air nozzles 68A-68C can increase with axial station S while inlet ends 72A-72C at the same axial station are located at the same radial location relative to axis A. Offsetting one or more inlet ends 72A-72C of respective air swirlers can discourage air flow through air swirlers of in active sub-element injectors.

In operation, pilot injector 28 discharges a pilot air-fuel mixture into a forward portion of combustion chamber 36 as depicted by FIG. 7. An igniter initiates combustion within combustor 16 and deactivates. As rotational speed of gas turbine engine 10 approaches and/or equals ground idle, main injector 32 discharges a first air-fuel mixture through sub-element mixer 64A while sub-element mixers 64B and 64C remain inactive. Upon commanding take-off power, main injector 32 discharges additional fuel through sub-element mixers 64B and 64C into combustion chamber 36 at a second air-fuel mixture. Subsequently, fuel flows through sub-element mixer 64A and sub-element mixers 64B and 64C may decrease during a climb operating condition of gas turbine engine 10, which may decrease further during at cruise. During a flight idle phase, main injector 32 may deactivate sub-element mixers 64B and 64C, reducing the fuel rate flowing therethrough to zero. At shutdown, residual fuel discharges into combustion chamber 36 and before gas turbine engine 10 decelerates and operation stops.

Main injector 32, by having multiple sub-element mixers (e.g., sub-element mixers 64A-66C and up to an arbitrary number "N" of sub-element mixers) arranged for axially staged combustion, reduces NOx and reduces particle size and particle quantity emitted by gas turbine engine 10. For instance, an air-fuel mixture discharged by main injector 32 can be localized to each sub-element mixer. Moreover, the air-fuel mixture discharged by each main injector 32 can be biased towards one or more groups of sub-element mixers. In one example, sub-element mixers 64A-64N with an axial station S closest to turbine section 18 can receive a greater percentage of fuel flow, a richer air-fuel ratio, and/or a leaner air-fuel ratio relative sub-element mixers closer to pilot injectors 30. In the example depicted by FIG. 5, FIG. 6, and FIG. 7, sub-element mixers 64B and 64C discharge a greater percentage of main injector fuel relative to sub-element mixer 64A when sub-element mixers 64A, 64B, and 64C are operating. For instance, sub-element mixers 64B and 64C can discharge between 50% and 90% of fuel discharged from main injector 32 while sub-element mixer 64A discharges the remainder of fuel from main injector 32 for a given air flow rate. Biasing fuel delivery to sub-element mixers disposed closer to turbine section 18 reduces the time combustion occurs within combustor 16 and, hence, reduces NOx emissions relative to conventional main injectors that discharge fuel closer to an upstream end of combustor 16. The bulk air-fuel mixture within combustor 16 (i.e., the net air-fuel ratio delivered by all pilot injectors 30 and main injectors 32) can be lean (i.e., less fuel than a stoichiometric air-fuel mixture) or rich (i.e., more fuel than a stoichiometric air-fuel mixture) depending on target air-fuel mixtures of pilot injectors 30 and main injectors 32.

DISCUSSION OF POSSIBLE EMBODIMENTS

The following are non-exclusive descriptions of possible embodiments of the present invention.

Main Fuel Injector with Clustered Sub-Element Mixers

A main injector for a continuous combustion chamber according to an example embodiment of this disclosure includes, among other possible things, a plurality of sub-element mixers. Each of the plurality of sub-element mixers comprises one of a plurality of main air nozzles and one of a plurality of main fuel nozzles. Each main air nozzle of the plurality of main air nozzles circumscribes a different main fuel nozzle of the plurality of main fuel nozzles. The plurality of sub-element mixers includes a first sub-element mixer comprising a first main air nozzle circumscribing a first main fuel nozzle and a second main sub-element mixer comprising a second main air nozzle circumscribing a second main fuel nozzle. The first main fuel nozzle and the first air swirler are operatively associated with a first air-fuel ratio that is different than a second air-fuel ratio operatively associated with the second main fuel nozzle and the second main air nozzle.

The main injector of the preceding paragraph can optionally include, additionally and/or alternatively, any one or more of the following features, configurations and/or additional components.

A further embodiment of the foregoing main injector can further include a peripheral body circumscribing the plurality of sub-element mixers.

A further embodiment of any of the foregoing main injectors, wherein each main air nozzle of the plurality of main air nozzles can abut at least one adjacent main air nozzle of the plurality of main air nozzles.

A further embodiment of any of the foregoing main injectors, wherein each main air nozzle of the plurality of main air nozzles can include an inlet end coinciding with respective inlet passages of the plurality of main fuel nozzles.

A further embodiment of any of the foregoing main injectors, wherein a first inlet end of the first main air nozzle can be offset radially from a second inlet end of the second main air nozzle.

A further embodiment of any of the foregoing main injectors, wherein the plurality of sub-element mixers can include a third sub-element mixer.

A further embodiment of any of the foregoing main injectors, wherein the third sub-element mixer can include a third main air nozzle circumscribing a third main fuel nozzle.

A further embodiment of any of the foregoing main injectors, wherein the third main air nozzle can be identical to the second main air nozzle.

A further embodiment of any of the foregoing main injectors, wherein the third main fuel nozzle can be identical to the second main fuel nozzle.

A further embodiment of any of the foregoing main fuel injectors, wherein the first main air nozzle can be between the second main air nozzle and the third main air nozzle.

A further embodiment of any of the foregoing main fuel injectors, wherein the first main air nozzle can be proximate the second main air nozzle and the third main air nozzle.

An Annular Combustor

An annular combustor for a gas turbine engine according to an example embodiment of this disclosure includes, among other possible things, an outer combustion liner assembly, an inner combustion liner assembly, a forward assembly, a pilot injector, and a main injector. The outer combustion liner assembly is spaced radially from the inner combustion liner assembly relative to an engine axis of the gas turbine engine. The forward assembly joins the inner combustion liner assembly to the outer combustion liner assembly. The pilot injector extends into the forward assembly. The main injector extends through the outer combustion liner assembly. The main injector includes a plurality of sub-element mixers. Each of the plurality of sub-element mixers comprises one of a plurality of main air nozzles and one of a plurality of main fuel nozzles. Each main air nozzle of the plurality of main air nozzles circumscribes a different main fuel nozzle of the plurality of main fuel nozzles. The plurality of sub-element mixers includes a first sub-element mixer comprising a first main air nozzle circumscribing a first main fuel nozzle and a second sub-element mixer comprising a second main air nozzle circumscribing a second main fuel nozzle.

The annular combustor of the preceding paragraph can optionally include, additionally and/or alternatively, any one or more of the following features, configurations and/or additional components.

A further embodiment of the foregoing annular combustor, wherein each sub-element mixer can include a peripheral body circumscribing the plurality of sub-element mixers.

A further embodiment of any of the foregoing annular combustors, wherein the first main fuel nozzle and the first main air nozzle can be operatively associated with a first fuel-to-air ratio that is different than a second fuel-to-air ratio operatively associated with the second main fuel nozzle and the second main air nozzle.

A further embodiment of any of the foregoing annular combustors, wherein each main air nozzle of the plurality of main air nozzles can abut at least one adjacent main air nozzle of the plurality of main air nozzles.

A further embodiment of any of the foregoing annular combustors, wherein each main air nozzle of the plurality of main air nozzles can be proximate to at least one adjacent main air nozzle of the plurality of main air nozzles.

A further embodiment of any of the foregoing annular combustors, wherein each main air nozzle of the plurality of main air nozzles can include an inlet end coinciding with respective inlet passages of the plurality of main fuel nozzles.

A further embodiment of any of the foregoing annular combustors, wherein a first inlet end of the first main air nozzle can be radially offset form a second inlet end of the second main air nozzle.

A further embodiment of any of the foregoing annular combustors, wherein the annular combustor can include an axial station defined as a linear distance measured parallel to the axis from a datum plane towards the main injector.

A further embodiment of any of the foregoing annular combustors, wherein the datum plane can intersect at least a portion of the forward assembly.

A further embodiment of any of the foregoing annular combustors, wherein the main injector can be oriented such that the axial station of the first main fuel nozzle and the first air nozzle is less than the axial station of the second main fuel nozzle and the second air nozzle.

A further embodiment of any of the foregoing annular combustors, wherein the plurality of sub-element mixers can include a third sub-element mixer.

A further embodiment of any of the foregoing annular combustors, wherein the third sub-element mixer can include a third main air nozzle circumscribing a third main fuel nozzle.

A further embodiment of any of the foregoing annular combustors, wherein the third main air nozzle can be identical to the second main air nozzle.

A further embodiment of any of the foregoing annular combustors, wherein the third main fuel nozzle can be identical to the second main fuel nozzle.

A further embodiment of any of the foregoing annular combustors, wherein the first main air nozzle can abut the second main air nozzle and the third main air nozzle.

A further embodiment of any of the foregoing annular combustors can further include an igniter.

A further embodiment of any of the foregoing annular combustors, wherein the igniter can extend through the outer combustion liner assembly between the axial locations of the pilot injector and the main injector.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A main injector for a continuous combustion chamber extending along an engine axis, the main injector comprising:

a plurality of sub-element mixers arranged in a cluster, the plurality of sub-element mixers comprising a plurality of main air nozzles and a plurality of main fuel nozzles, each main air nozzle of the plurality of main air nozzles circumscribing a different main fuel nozzle of the plurality of main fuel nozzles, the plurality of sub-element mixers comprising:

a first sub-element mixer comprising a first main air nozzle circumscribing a first main fuel nozzle; and a second sub-element mixer comprising a second main air nozzle circumscribing a second main fuel nozzle;

wherein the first main fuel nozzle and the first main air nozzle are operatively associated with a first air-fuel ratio that is different than a second air-fuel ratio operatively associated with the second main fuel nozzle and the second main air nozzle, and wherein each main air nozzle of the plurality of main air nozzles is proximate at least one adjacent main air nozzle of the plurality of main air nozzles, and wherein each main air nozzle of the plurality of main air nozzles includes an inlet end coinciding with respective inlet passages of the plurality of main fuel nozzles, and wherein a first inlet end of the first main air nozzle is offset from a second inlet end of the second main air nozzle with respect to the engine axis.

2. The main injector of claim 1, further comprising:

a peripheral body circumscribing the plurality of sub-element mixers.

3. The main injector of claim 1, wherein the plurality of sub-element mixers includes a third sub-element mixer, the third sub-element mixer comprising a third main air nozzle circumscribing a third main fuel nozzle.

4. The main injector of claim 3, wherein the third main air nozzle is identical to the second main air nozzle, and wherein the third main fuel nozzle is identical to the second main fuel nozzle.

5. The main injector of claim 4, wherein the first main air nozzle is disposed circumferentially between the second main air nozzle and the third main air nozzle.

6. An annular combustor for a gas turbine engine comprising:

an outer combustor liner assembly;

an inner combustor liner assembly spaced radially from the outer combustor liner assembly relative to an engine axis to form a combustion chamber;

a forward assembly joining the outer combustor liner assembly to the inner linear assembly;

a pilot injector extending into the forward assembly and configured to direct a pilot air-fuel mixture into the combustion chamber; and a main injector extending through the outer combustor liner assembly;

wherein the main injector includes:

a plurality of sub-element mixers arranged in a cluster, the plurality of sub-element mixers comprising a plurality of main air nozzles and a plurality of main fuel nozzles, each main air nozzle of the plurality of main air nozzles circumscribing a different main fuel nozzle of the plurality of main fuel nozzles, the plurality of sub-element mixers comprising:

a first sub-element mixer comprising a first main air nozzle circumscribing a first main fuel nozzle; and a second sub-element mixer comprising a second main air nozzle circumscribing a second main fuel nozzle.

7. The annular combustor of claim 6, wherein the main injector further comprises:

a peripheral body circumscribing the plurality of sub-element mixers.

8. The annular combustor of claim 7, wherein each main air nozzle of the plurality of main air nozzles abuts at least one adjacent main air nozzle of the plurality of main air nozzles.

9. The annular combustor of claim 6, wherein the first main fuel nozzle and the first main air nozzle are operatively associated with a first air-fuel ratio that is different than a second air-fuel ratio operatively associated with the second main fuel nozzle and the second main air nozzle.

10. The annular combustor of claim 9, wherein each main air nozzle of the plurality of main air nozzles includes an inlet end coinciding with respective inlet passages of the plurality of main fuel nozzles, and wherein a first inlet end of the first main air nozzle is radially offset form a second inlet end of the second main air nozzle.

11. The annular combustor of claim 10, wherein the annular combustor includes an axial station defined as a linear distance measured parallel to the axis from a datum plane towards the main injector, and wherein the datum plane is normal to the axis and intersects at least a portion of the head wall, and wherein the main injector is oriented such that the axial station of the first main fuel nozzle and the first air nozzle is less than the axial station of the second main fuel nozzle and the second air nozzle.

12. The annular combustor of claim 10, wherein the plurality of sub-element mixers includes a third sub-element mixer comprising a third main air nozzle circumscribing a third main fuel nozzle.

13. The annular combustor of claim 12, wherein the third main air nozzle is identical to the second main air nozzle, and wherein the third main fuel nozzle is identical to the second main fuel nozzle.

14. The annular combustor of claim 13, wherein the first main air nozzle abuts the second main air nozzle and the third main air nozzle.

15. The annular combustor of claim 14, wherein the annular combustor includes an axial station defined as a linear distance measured parallel to the axis from a datum plane towards the main injector, and wherein the datum plane is normal the axis and intersects at least a portion of the head wall, and wherein the main injector is oriented such that the axial station of the first main fuel nozzle and the first air nozzle is less than the axial station of the second main fuel nozzle, the second air nozzle, the third main fuel nozzle, and the third air nozzle.

* * * * *